United States Patent [19]

Stahl

[11] 4,376,434

[45] Mar. 15, 1983

[54] COOKING GRIDDLE VENTILATOR

[75] Inventor: Lawrence E. Stahl, Rocky Mount, N.C.

[73] Assignee: Hardee's Food Systems, Inc., Rocky Mount, N.C.

[21] Appl. No.: 239,584

[22] Filed: Mar. 2, 1981

Related U.S. Application Data

[63] Continuation of Ser. No. 67,331, Aug. 16, 1979, abandoned.

[51] Int. Cl.[3] ..... F24C 15/20

[52] U.S. Cl. ..... 126/299 D; 55/436; 55/DIG. 36

[58] Field of Search ..... 126/299, 214 D; 98/115 R, 115 VM; 55/436, DIG. 36

[56] References Cited

U.S. PATENT DOCUMENTS

| | | | |
|---|---|---|---|
| 2,077,496 | 4/1937 | Sonntag | 126/299 D X |
| 2,392,038 | 1/1946 | Gaylord | 126/299 D |
| 2,462,537 | 2/1949 | Mykiatiuk | 126/299 R |
| 2,868,108 | 1/1959 | Petersen | 126/299 D |
| 3,055,285 | 9/1962 | Gaylord | 126/299 D |
| 3,217,629 | 11/1965 | Ekern | 55/DIG. 36 |
| 3,376,804 | 4/1968 | Marks | 126/299 D |
| 3,380,371 | 4/1968 | Scheel | 98/115 VM |
| 3,854,388 | 12/1974 | King | 126/299 E |
| 4,050,466 | 9/1977 | Giuffre | 126/299 E |
| 4,071,019 | 1/1978 | King | 126/299 E |
| 4,072,143 | 2/1978 | Gaylord | 126/299 D |

*Primary Examiner*—Albert J. Makay
*Assistant Examiner*—Harold Joyce
*Attorney, Agent, or Firm*—Cushman, Darby & Cushman

[57] ABSTRACT

A downwardly and forwardly open shroud for a cooking station converges rearwardly and upwardly toward an outlet duct. A throat region of the shroud is provided with a removable panel having a slotted baffle. A gutter and sump are provided for catching condensate, grease and the like. The panel is easily removed for cleaning, for exchanging with a similar panel having a different size and/or shape of slotted baffle and the sump is placed for easy cleanout. Versions are shown wherein the shroud is wall-mounted at the cooking station or cart-mounted together with a mobile cooking station.

7 Claims, 5 Drawing Figures

COOKING GRIDDLE VENTILATOR

This is a continuation of application Ser. No. 67,331, filed Aug. 16, 1979, now abandoned.

BACKGROUND OF THE INVENTION

The present invention arose in an industry—fast food restaurants—in which there has been considerable recent efforts devoted to designing, making, installing and learning to use exhaust hoods with features such as water-washing of the exhaust gas stream; grease extraction; smoke char and grease aerosol filtration; odor-oxidation and the like all to be neighborly, to abate nuisances, to reduce fire danger and/or to comply with air pollution, safety and/or health laws and regulations of various political jurisdictions.

The best, and in the long run most durable and efficient of these systems, are ones which are well designed, well made, easy to operate correctly and difficult to operate incorrectly, and which receive recommended maintenance.

A successful hood system designed by the present inventor is shown and described in my commonly owned, copending U.S. patent application, Ser. No. 781,418, filed Mar. 25, 1977.

This system and others of the general sort were designed principally for use in connection with the preparation of food for lunches, dinners and similar mid- and late-day meals at which hamburgers and similar fat-containing meat patties and the like are served in a grilled condition. Normally the grease, smoke and odor stream coming off such a cooking operation is intense and the investment in and faithful operation of such a heavy duty hood system is fully justified, even though the energy cost for running such a system is costly and is rapidly becoming even more costly.

Owners, operators and franchisors of fast food restaurants are constantly in search of ways to obtain a higher return on their investment in each store. An amount of attention that a lay person would find almost incredible is devoted to seeming minutiae: e.g. how better to cook a french fry or whether to pierce meat patties before or after they have been at least partially frozen in order that they can be cooked with less energy yet not too many of them broken or disfigured in the piercing step. It is inevitable that part of such attention be devoted to experimenting with also offering foods that would normally be in demand at other times of the day, principally at times that would be breakfast time and snack time for most people. Some people eat hamburgers for breakfast and there is no sense discouraging that, but for most fast food stores there is more business to be gotten at breakfast if grilled sausage patties, fried-egg product or fried-egg substitute, fried ham slices, griddle cakes and similar griddle-fried patties are offered.

The growing practice of fast food restaurants moving into the breakfast and snack serving businesses has "changed the equations" for efficient running of such restaurants and for coping with the need to maintain air quality control for the restaurants' cooking-exhaust gas streams. For such breakfast cooking there is bound to be less beef fat globules, aerosol and char and associated odorous aldehydes and ketones coming off the cooking surfaces, and more steam, lighter oils, fats and the like.

There often is a need, when griddle cooking to conserve heat at the cooking surface by not over-exhausting the air in the vicinity of the griddle.

Because of the overlapping of mealtimes—some are eating their first meal of the day while others are ready for their second or third—and because the foods that are to be cooked are different, it generally makes sense to add to cooking capacity when cooking hours are being expanded into an additional, e.g. breakfast mealtime.

With all of the above in mind it seemed best to take a fresh look at what kind of an exhaust gas stream collector/processor to put over a fast food restaurant's breakfast griddle-cooking work station. As will be seen from the following, it presently seems to the present inventor that the ideal piece of equipment is radically different from the system shown and described in his aforementioned copending U.S. patent application.

SUMMARY OF THE INVENTION

A downwardly and forwardly open shroud for a cooking station converges rearwardly and upwardly toward an outlet duct. A throat region of the shroud is provided with a removable panel having a slotted baffle. A gutter and sump are provided for catching condensate, grease and the like. The panel is easily removed for cleaning, for exchanging with a similar panel having a different size and/or shape of slotted baffle and the sump is placed for easy cleanout. Versions are shown wherein the shroud is wall-mounted at the cooking station or cart-mounted together with a mobile cooking station.

It is an object of the invention to provide means for conducting grease-laden aerosols and gases from a food preparation area to a more remote discharge point with some intermediate removal or modification of the exhaust stream contents.

The device of the invention permits the operator to substantially change the store's menu, and not have to buy a whole new hood. Instead a mere change-out of a mechanical extractor slotted baffle panel may be all that is needed. Also, the device may be similarly simply modified when the store's ventilation characteristics are radically changed, e.g. when new buildings are put up or old ones are taken down on adjacent properties, when draft is changed by installation of airlock-type store entrance doors for winter business, when the store air conditioning system is put into seasonal use and the like.

The device of the invention is a low cost alternative for use at work stations where there are no or not many hamburger patties being grilled. It does not require inlet plumbing, or drainage to a sewer. It works properly with far less CFM in the exhaust gas stream and far less of a static pressure drop across the baffle plate than conventional grease extraction hoods, and can provide a considerable savings in manufacturing, acquisition, installation, use and maintenance costs.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION OF THE PRESENTLY PREFERRED EMBODIMENTS

Figure 1:
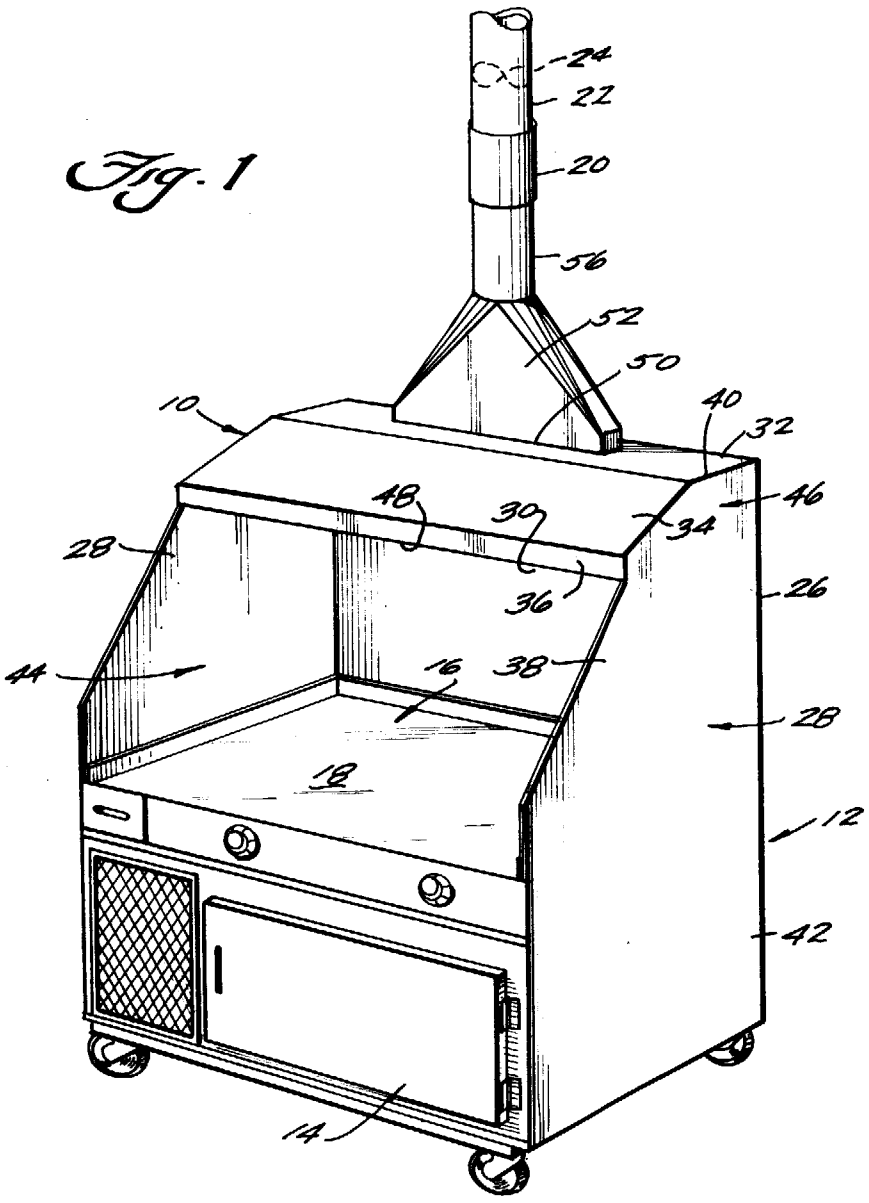
FIG. 1 is a perspective view of the cooking griddle ventilator, shown integrated with a mobile cooking station.

In FIG. 1, the cooking griddle ventilator 10 is shown set up for use in conjunction with a mobile cart 12 which has an under-the-counter refrigerator unit at 14 and a counter-top cooking griddle unit 16 with an upwardly facing cooking griddle surface 18. The cooking griddle ventilator 10 is shown disconnectably connected via a quick disconnect joint 20, with an exhaust stack 22 which incorporates a preferably variable-output exhaust fan 24. The unit 12 per se does not form part of the present invention, nor does the exhaust stack 22. It would be possible to install the fan 24 upstream of the quick disconnect joint 22, in which case the fan 24 would form part of the device 10.

The cooking griddle ventilator 10 includes a shroud 26, e.g. of stainless steel sheet fabricated so as to have left and right end walls 28, a rear wall 30, a top wall 32, and a partial front wall with a sloping portion 34 and a lintel portion 36. The walls 28, 30 and 36 are generally vertical. The end walls each include a generally, upwardly tapering triangular main portion 38, truncated at 40 and having an integral depending skirt 42 of generally rectangular form. Accordingly, the cooking surface 18 remains fairly open and accessible through the generally open lower front 44 of the shroud, yet cooking effluent rising off the griddle can be drawn under and into the canopy 46 region of the shroud by a combination of connection operation of the exhaust fan 24. (The canopy 46 is defined as all of that region of the shroud which lies above the lip 48 of the lintel 36.)

It should be noticed that the top wall 32 of the shroud 26 is provided in the rear half thereof with a generally rectangular upwardly open slot 50 that is elongated in a left-to-right sense.

A rectangular-to-round transition duct 52 is fitted into the slot 50. Preferably the slot 50 is formed with an axially short, upwardly projecting perimetrical lip 54 and the lower end region of the transition duct 52 is frictionally fitted a short way down into the slot so as to be closely (e.g. air tightly) bounded by the lip 54.

The round-sectioned upper end region 56 of the transition duct 52 is sized to be coupled via the quick disconnect sleeve joint 20 with the exhaust stack 22. (The latter is permanently installed in the restaurant building and leads, remotely, to the exterior, e.g. at the roof or back of the store, where it is vented to the atmosphere.)

Most of what is different about the device 10 is the structure that is hidden up under the canopy so that it does not show in FIG. 1. It is shown in detail in FIG. 2.

Figure 2:
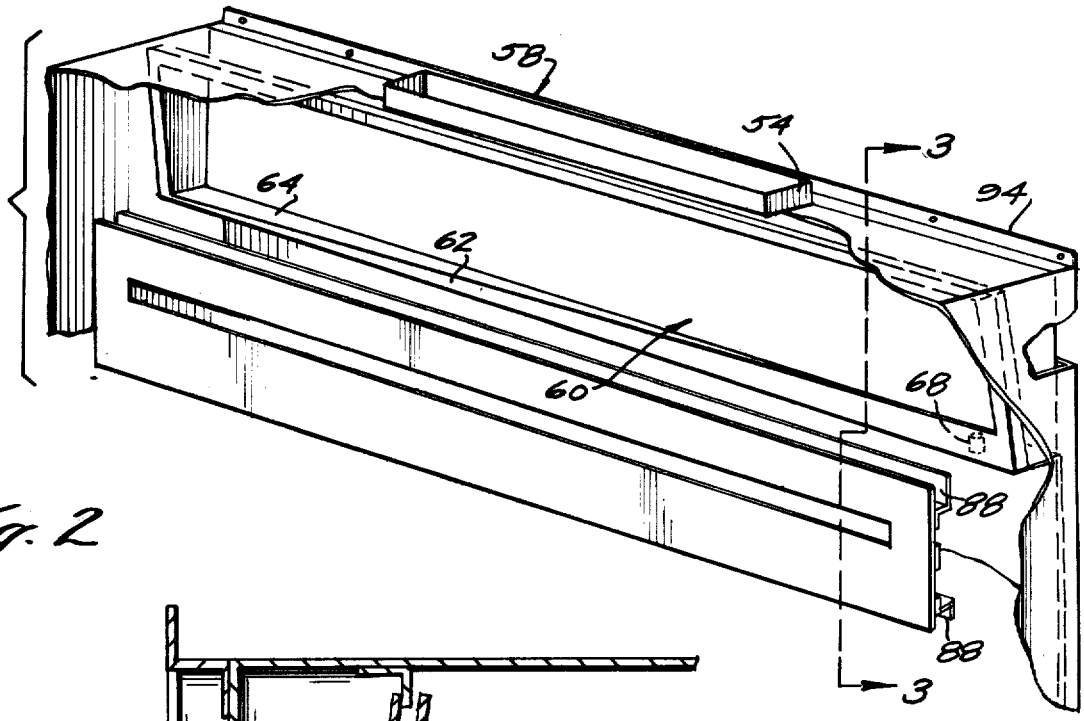
FIG. 2 is an enlarged fragmentary perspective view of the inner gutter assembly and removable slotted baffle plate of the ventilator device of FIG. 1.
Figure 3:
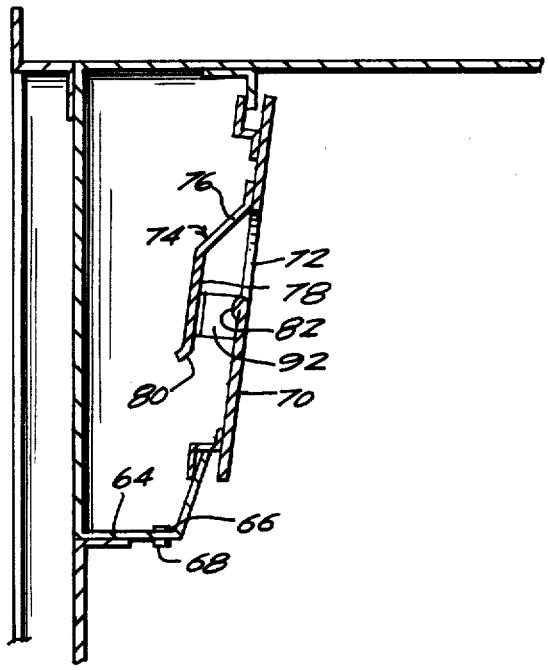
FIG. 3 is an assembled cross-sectional view on line 3—3 of FIG. 2.
Figure 4:
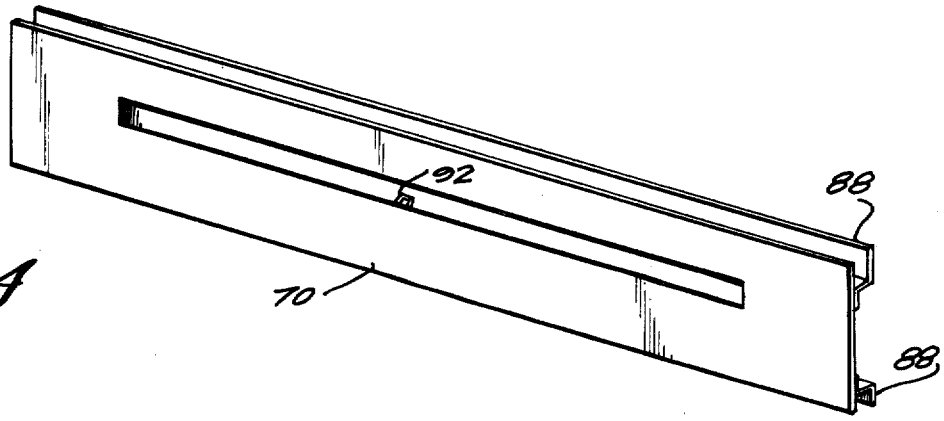
FIG. 4 is a perspective view of another removable slotted baffle plate which may be exchanged for the one shown in FIG. 2.

Referring to FIG. 2, the end walls 28, top wall 32 and rear wall 30 of the shroud 26 are partially illustrated in order to set the scene. The lipped slot 50 for the outlet transition duct also is shown. Standing out forwardly of the rear wall 30 under the canopy 46 is a gutter assembly 58, which has the appearance of a slightly askew or mishapen shadow-box picture frame. One way that it can be fabricated together with the rear wall is well-illustrated in FIG. 3. In general, although the generally upright, slightly pitched-forwards front opening 60 is generally rectangular, the lower rail 62 of the four-sided perimetrical border of that front opening increases in web height as it proceeds rightwards (FIG. 2 orientation). This corresponds with a sloping downwards to the right of the gutter floor 64, which extends between the lower edge of the rail 62 and the rear wall 30, and between the left and right end walls 28 of the shroud 26. At the low end, the floor 62 is provided with a drain opening 66 having a short nipple 68 projecting downwards therefrom.

The mechanical extractor is in the form of an easily removable slotted baffle panel 70. The panel 70 is substantially rectangular and generally upright, though elongated in a left-to-right sense and has a left-to-right elongated slot 72 formed therethrough. A generally inverted L-shaped baffle flange 74 is secured to the back side of the panel 70 just over the slot 72, so that the exhaust gas stream issuing through the slot cannot go upwards or further rearwards, but must pass downwards, around the baffle flange. By preference, the upper wall 76 of the baffle flange 74 slopes downwards somewhat, so that a substantial amount of the exhaust gas stream will impinge thereon and be directed downwardly. The lower edge of the vertical wall 78 has a short oblique skirt 80 which acts to stiffen the wall 78 and provides an edge region from which condensate may drip into the gutter 62/64.

A removable grease trap 84, in the form of a pail, is mounted on the shroud via a bracket 86 so as to be in drip-catching relation to the nipple 68.

The upper and lower edges of the baffle panel 70 are provided with respectively upwardly and downwardly opening U-shaped channels 88 which permit the panel to be removably mounted in the gutter assembly opening 60 as a partial restriction thereof. The mounting and removal technique will be familiar to those who have aluminum storm windows or the like, where the panel is first lifted into position in order to accept the gutter opening upper border into the upper channel 88, then rotated into the plane of the gutter opening 60 and lowered to also accept the gutter opening lower border into the lower channel 88.

Some typical dimensions and materials now are given for illustration for further disclosing details of a best mode. The device 10 preferably is fabricated of eighteen gauge stainless steel. Securement is by welding the free edges exposed for casual contact are hemmed as at 82. The shroud front opening, from griddle surface 18 to lintel 36 is about two feet, and about four feet wide. In this same example, the throat at 50 measures about 1.85 feet by 0.17 feet. The exhaust stack 22 is 0.5 feet in diameter. The opening 60 of the gutter assembly measures 0.58 feet by four feet. The panel 70 measures 0.65 feet by four feet, and in this particular instance, the opening 72 measures 0.083 feet by 3.67 feet. The clearance at 90 also is 0.083 feet.

In the version shown in FIG. 1, the end walls 28 are integral with the end walls of the mobile cart 12.

In FIG. 2, the structures 92 are tab like stiffeners which interconnect the baffle flange 74 and panel 70 at the two ends and the middle below the slot 72 in order to brace or stiffen the composite structure.

Figure 5:
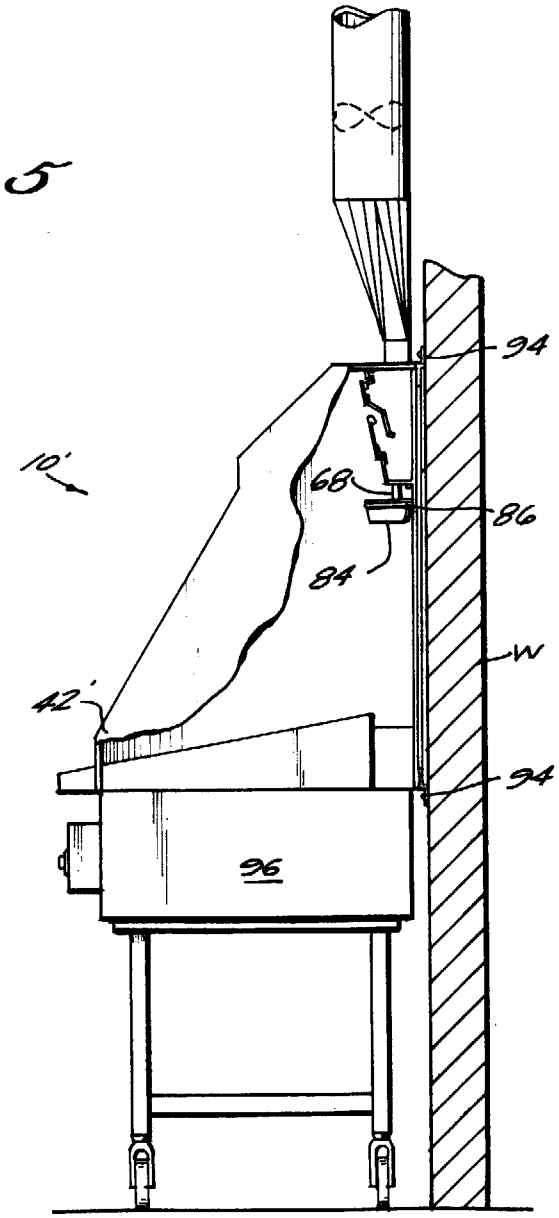
FIG. 5 is a side elevational view of a wall-mounted version of the cooking griddle ventilator, with the near end wall of the shroud broken away to expose interior details, this ventilator being shown in association with a cooking griddle.

The flanges 94 shown bordering the upper and lower edges of the shroud 26 back wall 30 are used in the embodiment of FIG. 5 for securing the device 10' to a wall W at the work station, e.g. so that it bears the same functional relation to the separate griddle unit 96 (in this case also cart-mounted) as does the unit 10 when integrated with the work station cooking griddle unit 16 in FIG. 1. Accordingly, the skirts 42' extend downwards sufficiently to terminate below the cooking surface of the griddle unit 96.

In a test, a 48 inch wide device 10' was run with a 30 inch wide griddle unit 96 loaded with cooking sausage patties or slices of ham. Temperature at the exhaust stack 22 was 82° F.; temperature at the shroud skirt, measured at point 96 (FIG. 5) was 110° F. Room temperature was 78° F. The results are tabulated as follows:

TABLE I

| Run No. | Area of Slot 70 (IN.$^2$) | Linear Velocity at Point 98 (F.P.M.) | Mass Velocity at Point 98 (C.F.M.) | S.P.W.C. at Point 100 (Inches) | Remarks |
|---|---|---|---|---|---|
| 1 (sausage) | 0.305 (1×44) | 600 | 183 | 1.25 | No smoke leakage visible. |
| 2 (sausage) | 0.305 | 294 | 89.6 | 0.50 | Slight smoke leakage visible. |
| 3 ( ) | 0.305 | 300 | 72.9 | 0.50 | |
| 4 (ham) | 0.243 (1×35) | 463 | 141 | | No smoke leakage visible. |
| 5 (ham) | 0.243 | 383 | 117 | 0.7 | No smoke leakage visible. |
| 6 (sausage) | 0.243 | 687 | 210 | 1.75 | No smoke leakage visible. |

Presently velocities produced by operation as per runs 5 and 6 seem ideal for frying ham and sausage patties, respectively.

In general, the object is to use as little energy as possible to operate the fan, consistent with pulling into the canopy substantially all the visible smoke coming off the griddle cooking surface.

Although the device of the invention is specifically tailored for use in fast food restaurant food griddle-cooking operations, it should be apparent that the devices 10, 10' may find analogous uses in the restaurant and other industries.

It should now be apparent that the cooking griddle ventilator as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A ventilator for a generally rectangular, upwardly facing cooking station such as a griddle, comprising:

a downwardly and forwardly opening shroud which converges rearwardly and upwardly toward an outlet duct means forming a part thereof;

said shroud being characterized by a lack of inlet plumbing and a lack of water spray nozzles;

said shroud including a canopy having a throat region therewith, including means for removably mounting a slotted baffle panel across said throat region;

a slotted baffle panel removably mounted across said throat region via said mounting means;

said slotted baffle panel disposed within said canopy and having vertically short, laterally elongated baffled slot means therethrough having a predetermined facial area measuring no more than about one inch in height;

said mounting means further including an inclined grease gutter located downstream of said removable slotted baffle panel and having a lowest region and a collector positioned at said lowest region to collect grease draining thereinto from said gutter;

said shroud including two opposite end walls, a rear wall extending between said two opposite end walls from top to bottom, all three of which extend downwards at least to the level of said generally rectangular, upwardly facing cooking station, and a substantially shorter front wall having a lintel portion with a lower edge disposed about two feet above the level of said generally rectangular, upwardly facing cooking station; said lower edge defining the lower edge of said canopy, said opposite end walls defining corresponding opposite end walls of said canopy and said rear wall defining a corresponding rear wall of said canopy; said sidewalls at the bottoms thereof being substantially as deep, in a front to back sense, as said generally rectangular, upwardly facing cooking station; said canopy being substantially less deep than said cooking station and overlying a rearmost portion of said cooking station; and said sidewalls having front edges which extend obliquely rearwardly as they extend upwardly from the bottoms of said sidewalls to the canopy.

2. The ventilator of claim 1, further including:

an extension of said outlet duct means mounted on a building; and an exhaust fan interposed in said extension of said outlet duct means and operated to draw airborne emissions through said slot at a face velocity in the range of about 463 feet per minute to about 687 feet per minute and at a mass velocity of about 117 cubic feet per minute to about 210 cubic feet per minute.

3. The ventilator of claim 2, further including:

a quick disconnect fitting removably interconnecting said outlet duct means with said extension thereof.

4. The ventilator of claim 1, further including:

mounting means on said shroud for securing said shroud to a building wall at a cooking station.

5. The ventilator of claim 1, further including:

a mobile cart having a cooking griddle with an upwardly facing griddle surface;

said mobile cart having housing upright wall means which are provided as unitary extensions of geometrically corresponding portions of said shroud from the respective bottoms thereof.

6. The ventilator of claim 1, further including:

a second removably slotted baffle panel which is identical to the first-mentioned slotted baffle panel and is provided for use exchangeably therewith;

said slot means of said second removably slotted baffle panel having a substantially different facial area than that of the first-mentioned slotted baffle panel.

7. The ventilator of claim 1, in combination with a cooking griddle having an upwardly facing griddle surface constituting said generally rectangular, upwardly facing cooking surface.

* * * * *